United States Patent [19]

Baxter

[11] Patent Number: 5,048,307

[45] Date of Patent: Sep. 17, 1991

[54] CYLINDRICAL COOLING AND INSULATING CONTAINER

[75] Inventor: Gregory M. Baxter, Allen St., #304, Dallas, Tex. 75204

[73] Assignee: Gregory M. Baxter, Dallas, Tex.

[21] Appl. No.: 369,299

[22] Filed: Jun. 21, 1989

Related U.S. Application Data

[63] Continuation-in-part of Ser. No. 275,114, Nov. 21, 1988.

[51] Int. Cl.[5] ..... F25D 3/08

[52] U.S. Cl. ..... 62/457.4; 62/372; 62/457.5; 62/518; 62/530

[58] Field of Search ..... 62/457.2, 457.3, 457.4, 62/372, 530, 430, 518, 457.5; 206/407

[56] References Cited

U.S. PATENT DOCUMENTS

| | | | |
|---|---|---|---|
| D. 266,305 | 9/1982 | Scheurer | D7/77 |
| 2,926,508 | 3/1960 | Moon . | |
| 3,161,031 | 12/1964 | Flannery . | |
| 3,205,677 | 9/1965 | Stoner . | |
| 3,205,678 | 9/1965 | Stoner . | |
| 3,302,427 | 2/1967 | Stoner . | |
| 3,553,976 | 1/1971 | Cumine et al. | 62/518 X |
| 4,344,303 | 8/1982 | Kelly, Jr. | 62/430 |
| 4,514,993 | 5/1985 | Johnson | 62/372 |
| 4,517,815 | 5/1985 | Basso | 62/457.5 |
| 4,573,329 | 3/1986 | Cavalli | 62/518 X |
| 4,612,781 | 9/1986 | Swerdon | 62/372 |
| 4,711,099 | 12/1987 | Polan | 62/457.4 |
| 4,741,176 | 5/1988 | Johnson | 62/530 |

*Primary Examiner*—Lloyd L. King

[57] ABSTRACT

A substantially cylindrical container constructed of a plurality of flexible tubes connected edge to edge. The plurality of tubes are folded in a cylindrical form, and a connector is inserted into and bonded with the open ends of the tubes thereby forming a unitary substantially cylindrical structure. The tubes may be colored or may have colored fluid contained therein. The connector may be a single piece connector with a plurality of connecting elements, or may be a two-piece connector, each piece having complementary mating structures which are snapped together after the pieces are inserted into and bonded with respected ends of the plurality of flexible tubes.

18 Claims, 4 Drawing Sheets

CYLINDRICAL COOLING AND INSULATING CONTAINER

This application is a continuation-in-part of copending application Ser. No. 07/D275,114, filed Nov. 21, 1988.

BACKGROUND OF THE INVENTION

The invention relates to a cylindrical cooling, and insulating container for holding beverage receptacles, such as cans, bottles, and the like.

Several different types of beverage receptacle holders and coolers exist. Most of them are intended to provide an insulating effect in order to maintain a beverage contained in a bottle or can hot or cold. In addition, to providing an insulating effect, several beverage receptacle holders include a freezable liquid to enhance their cooling effect.

SUMMARY OF THE INVENTION

The present invention is a substantially cylindrical container which can be used to hold a beverage receptacle, such as a can, bottle or the like. The cylindrical container is made up of individual flexible tubes which are joined edge to edge, and which are bent and joined end-to-end to form a substantially cylindrical container. A bottom piece can be inserted into one end of the cylindrical container to close off one end thereof.

The ends of the individual tubes are connected using a connecting member which is preferably one piece. One embodiment of this connecting member includes a number of individual connecting elements formed separately or each connected or commonly formed edge to edge. A first end of each connecting element is inserted into and bonded with the interior of a first end of each of the individual tubes, and a second end of each connecting element is inserted into and bonded with the interior of a respective second end of each of the individual tubes.

A second embodiment of the connecting member is a two-piece connector, a first piece being inserted into and bonded with a first end of the plurality of tubes and having a male shaped mating structure, and the second piece being inserted into and bonded with a second end of the plurality of tubes and having a complementary female shaped mating structure. Use of the two-piece connector allows the cylindrical container of the present invention to be shipped and stored flat, and then assembled into a cylindrical container by snapping the male structure into the female structure.

The individual tubes can be filled with a freezable liquid which can be frozen to impart cooling properties to the present invention. Whether or not frozen, the liquid and tubes, in addition to the air trapped between the interior wall of the present invention and a can or bottle contained therein, together act as a thermal insulator between the can or bottle and ambient temperature.

DETAILED DESCRIPTION OF THE PREFERRED EMBODIMENTS

Figure 1:
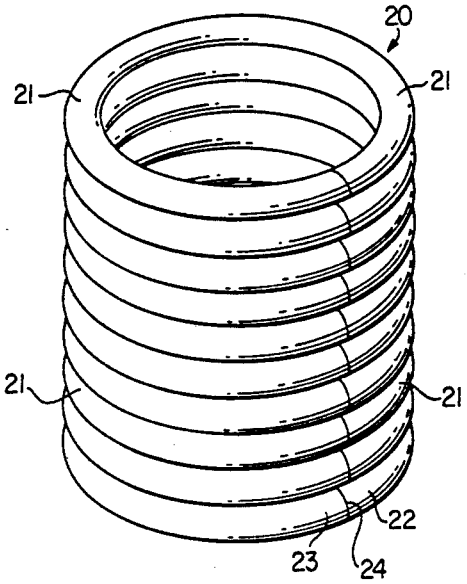
FIG. 1 is an isometric view of a first embodiment of the present invention.
Figure 2:
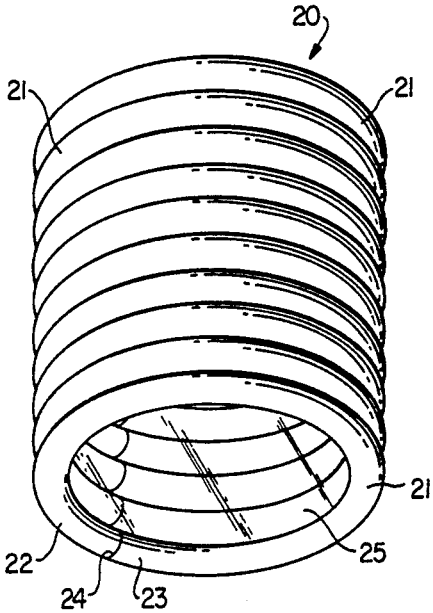
FIG. 2 is another isometric view of the first embodiment of the present invention.
Figure 3:
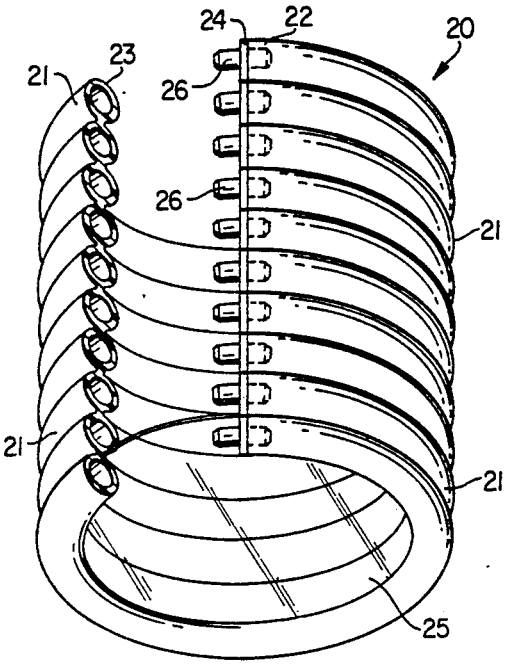
FIG. 3 is another isometric view of the first embodiment of the present invention in partial cross-section.

Referring to FIGS. 1, 2 and 3, a cylindrical container 20 according to a first embodiment of the present invention is shown. Cylindrical container 20 includes a plurality of flexible hollow tubes 21 bonded edge to edge to form a stack of tubes 21. Each individual tube 21 has a first end 22 and a second end 23. The first and second ends 22, 23 of each tube 21 are connected to each other by connector 24. Connector 24 is configured to fit snugly within the interior of each tube 21.

Tubes 21 can be made of any flexible material, for example flexible plastic material such as polyvinyl chloride, styrene, polystyrene, polyethylene, urethane, polyurethane, polypropylene or thermoplastic polyester. The listing of materials here and elsewhere in this application is by way of example only and should not be considered to limit the scope of the invention. The preferred material for tubes 21 is polyvinyl chloride. Tubes 21 are preferably substantially transparent, however, they may be colored by a suitable dye. Tubes 21 may be bonded edge to edge using a variety of methods. For example, if tubes 21 are made from polyvinyl chloride, a volatile solvent such as cyclohexanone, available from Unocal Chemicals Division of the Union Oil Company, can be used. Other solvents or adhesives well known in the plastics art can also be used. In the alternative, tubes 21 can be bonded edge to edge by use of ultrasonic or thermal bonding methods, well known in the art. Finally, two or more of tubes 21 can be commonly extruded as a single stacked unit.

Each of tubes 21 is preferably hollow and can be filled with a liquid. The liquid is preferably freezable, however freeze prone liquids can be used. The preferred liquid used to fill each tube 21 is water. The water can be appropriately dyed in order to add color to individual tubes 21 of cylindrical container 20. Other liquids, such as propaline glycol or a freezable gel of the type commonly known as "blue ice," can also be used.

Substantially circular bottom portion 25 can be included to close off one end of cylindrical container 20. Bottom portion 25 is preferably, but need not be, transparent, and can be made from plastic materials such as acrylic, polycarbonate, fluroplastic, polyimide or polyolefin.

Connector 24 is constructed of individual connecting elements 26, each of which are configured to fit snugly within the interior dimension of tubes 21. Individual connecting elements 26 are preferably injection molded from flexible plastic material such as polyvinyl chloride, styrene, polystyrene, polyethylene, urethane, polyurethane, polypropylene or thermoplastic polyester. Connecting elements 26 are bonded to the interior of tubes 21 by use of a volatile solvent such as cyclohexanone, or by use of adhesive, ultrasonic or thermal bonding methods, well known in the art. Cylindrical container 20 is thus a unitary structure. Connector 24 can be formed of separate individual connecting elements 26, or, as described in more detail below, can be formed of connected connecting elements 26.

Figure 4:
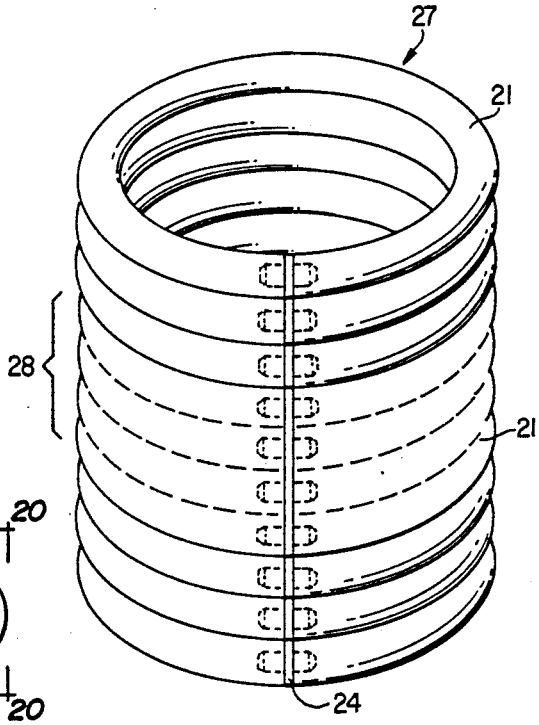
FIG. 4 is an isometric view of another embodiment of the present invention.

Referring to FIG. 4, an alternate embodiment of the cylindrical container of the present invention is disclosed. Cylindrical container 27 once again is constructed from a plurality of individual tubes 21 which are bonded edge to edge, and which are connected end to end by connector 24, as described above in connection with FIGS. 1–3. A number of the plurality of tubes 21 have a flattened exterior surface, and when bonded edge to edge form flattened portion 28 of cylindrical container 27. Flattened portion 28 can be used as a writing surface, or for application of labels, or the like.

Figure 5:
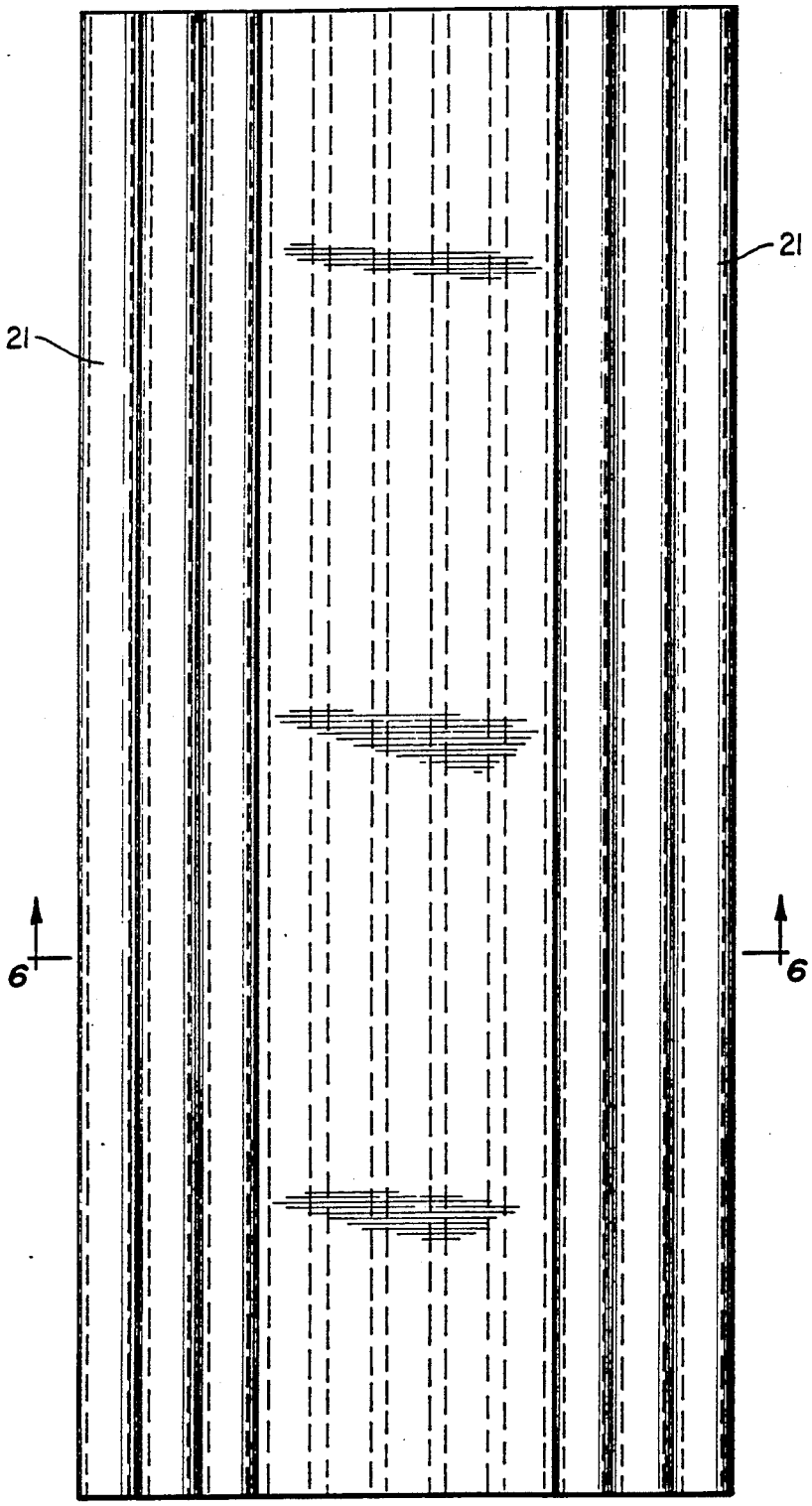
FIGS. 5 and 6 are views of tubes used to construct the embodiment of FIG. 4.
Figure 6:
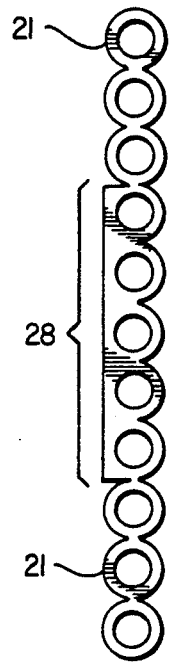

Referring to FIGS. 5 and 6, a plurality of tubes 21 which have been commonly extruded as a unit including flattened surface 28 are shown. Alternatively, only tubes which together constitute flattened surface 28 can be commonly extruded while the remainder of tubes 21 can be bonded to form a unitary structure.

Figure 9:
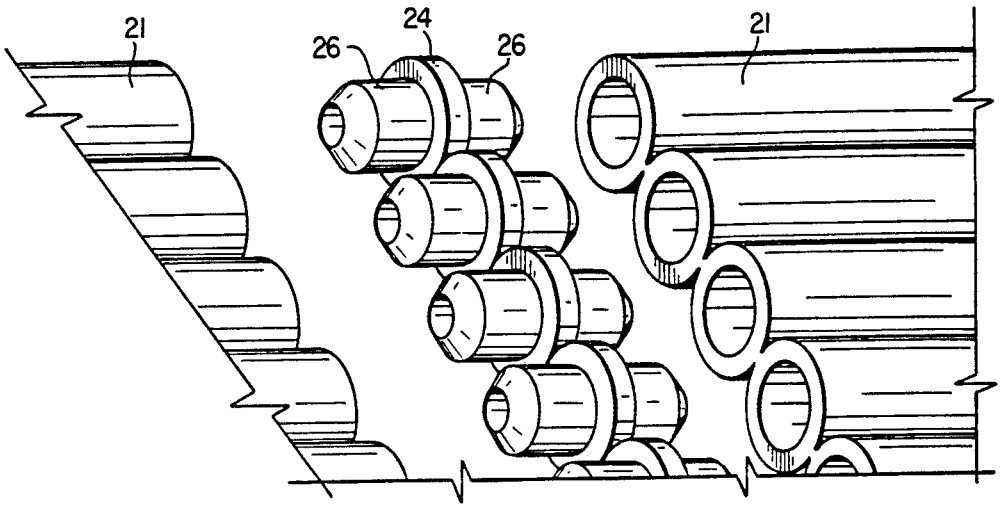
FIGS. 7, 8 and 9 are views of a first embodiment of a one-piece connector usable to construct the containers of FIGS. 1–4.
Figure 7:
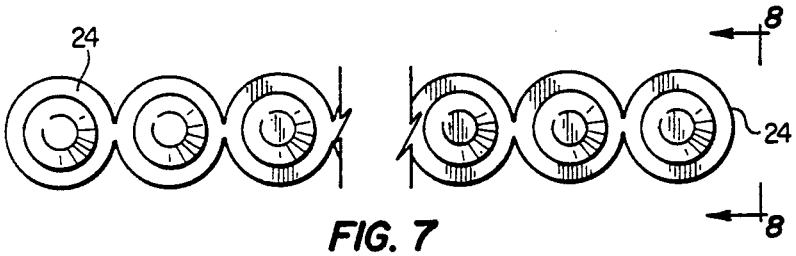
Figure 8:
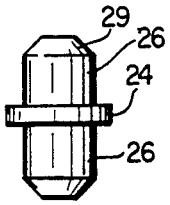

Referring to FIGS. 7, 8 and 9, a first embodiment of connector 24 is shown. Connector 24 includes a number of individual connecting elements 26. The outside diameter of each connecting element 26 is dimensioned to fit snugly within the inside diameter of individual tubes 21. Connector 24 including individual connecting elements 26 is preferably molded as a single unit from flexible plastic material such as polyvinyl chloride, styrene, polystyrene, polyethylene, urethane, polyurethane, polypropylene or thermoplastic polyester. In FIGS. 7–9, each individual connecting element 26 includes convex end surfaces 29. If connector 24 and tubes 21 are both polyvinyl chloride, individual connecting elements 26 can be bonded to the inside of tubes 21 by use of a volatile solvent such as cyclohexanone.

Figure 10:
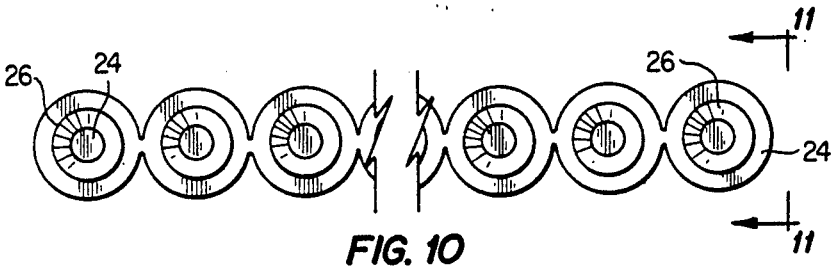
FIGS. 10 and 11 are views of a second embodiment of a one-piece connector usable to construct the containers of FIGS. 1–4.
Figure 11:
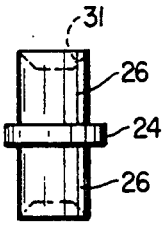

FIGS. 10 and 11 disclose yet another embodiment of connector 24 including individual connecting elements 26. In FIGS. 10 and 11, individual connecting elements 26 include concave end surfaces 31.

Referring now to FIGS. 12–16, another embodiment of connector 24 is presented. Connector 24 includes first connector piece **24*a* and second connector piece 24*b*, each of which include individual connecting elements 26*a* and 26*b***, respectively.

Figure 16:
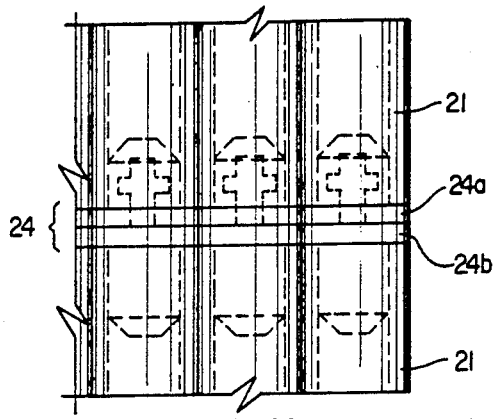
FIGS. 12, 13, 14, 15 and 16 are views of a first embodiment of a two-piece connector usable to construct the containers of FIGS. 1–4.
Figure 15:
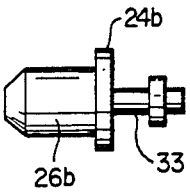
Figure 13:
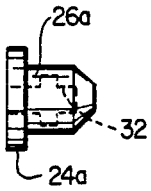
Figure 14:
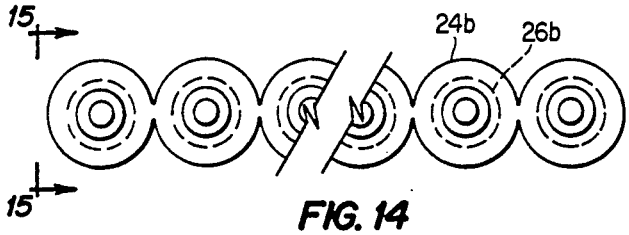
Figure 12:
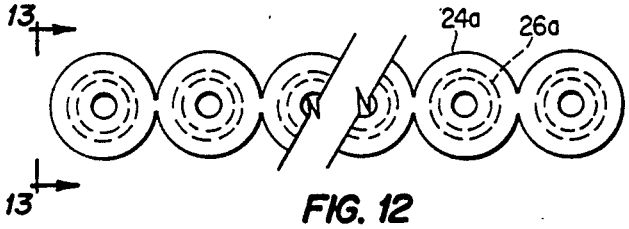

In FIGS. 12 and 13, first connector piece **24*a* includes individual connecting elements 26*a*. Each individual connecting element 26*a* includes a female-shaped connecting portion 32 formed in the interior thereof. Referring to FIGS. 14 and 15, second connector piece 24*b* includes individual connecting elements 26*b*, each of which include male +-shaped connecting portion 33 which is complementary in shape to female connecting portion 32. As shown in FIG. 16, after the first and second connector pieces 24*a* and 24*b* are inserted into and bonded with individual tubes 21, each male connecting portion 33 is snapped into a complementary female connecting portion 32 to form a substantially unitary cylindrical structure 20, 27 as shown in FIGS. 1–4**.

Figure 21:
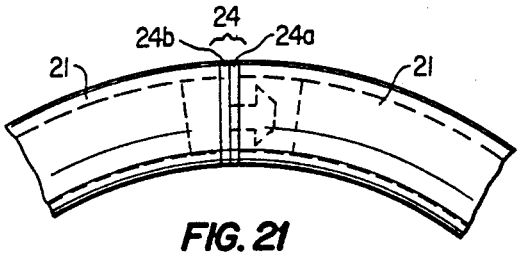
FIG. 21 is the connector of FIGS. 17, 18, 19 and 20 in place.
Figure 17:
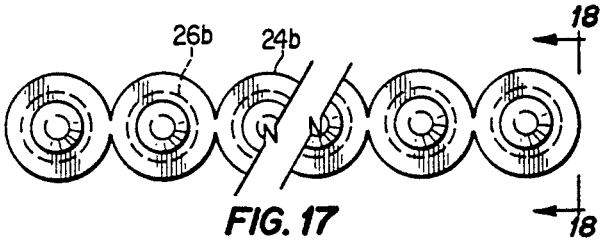
FIGS. 17, 18, 19 and 20 are views of a second embodiment of a two-piece connector usable to construct the containers of FIGS. 1–4.
Figure 20:
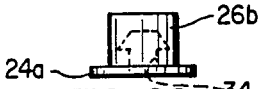
Figure 18:
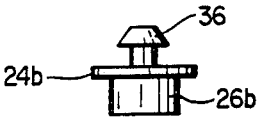
Figure 19:
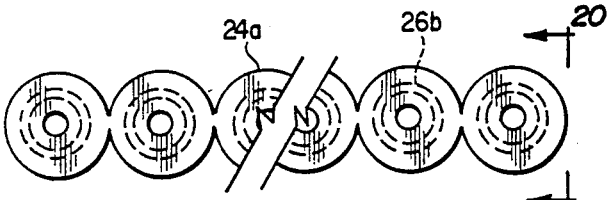

Referring now to FIGS. 17–20, a second embodiment of a two-piece connector 24 is shown. Once again, connector 24 includes female connector piece **24*a* and male connector piece 24*b*. Female connector piece 24*a* includes individual connecting elements 26*a*, each of which include frusto-conical shaped female connecting portion 34 formed in the interior thereof. Similarly, male connector piece 24*b* includes individual connecting elements 26*b*, each of which includes individual frusto-conical shaped male connecting portions 36. As shown in FIG. 21, after female connector 24*a* is inserted into and bonded with first ends of individual tubes 21, and male connector 24*b* is inserted into and bonded with second ends of individual tubes 21, male connecting portion 34 is snapped into female connecting portion 36 to form a substantially cylindrical container 20, 27 as shown in FIGS. 1–4**.

By using the two-piece connectors of FIGS. 12–15 or FIGS. 17–20, cylindrical container 20, 27 can be stored and shipped flat, and can be simply assembled into a substantially cylindrical finished unit.

While the present invention has been disclosed with reference to several preferred embodiments, one of ordinary skill in this art will understand that modifications, deletions and additions to the disclosed preferred embodiments can be made, without departing from the spirit and scope of the invention.

I claim:

1. A substantially cylindrical, thermally insulated container for a beverage receptacle, comprising:

a plurality of flexible hollow tubes joined edge to edge to form a stack of tubes with first and second open ends, each of said plurality of tubes having a substantially fixed radial dimension;

a plurality of connectors, each having a first end inserted into and bonded with said first open end of a respective one of said plurality of tubes, and a second end inserted into and bonded with said second open end of said respective one of said plurality of tubes, whereby said first and second open ends are connected to form a substantially cylindrical inner surface of said container to accommodate a substantially cylindrical outer surface of a beverage receptacle.

2. A container as recited in claim 1, wherein said plurality of flexible hollow tubes are joined edge to edge by bonding.

3. A container as recited in claim 2, wherein said plurality of flexible hollow tubes are joined edge to edge by solvent bonding.

4. A container as recited in claim 2, wherein said plurality of flexible hollow tubes are joined edge to edge by ultrasonic bonding.

5. A container as recited in claim 1, wherein at least two of said plurality of flexible hollow tubes are extruded as a unit.

6. A container as recited in claim 1, wherein at least a portion of an exterior of said container forms a substantially smooth cylindrical surface.

7. A container as recited in claim 1, wherein said plurality of flexible hollow tubes are filled with liquid.

8. A container as recited in claim 7, wherein said liquid is freezable.

9. A container as recited in claim 8, wherein said liquid is water.

10. A container as recited in claim 9, wherein said liquid is colored water.

11. A container as recited in claim 1, wherein said plurality of flexible hollow tubes are made from flexible polyvinyl chloride.

12. A container as recited in claim 1, wherein said plurality of connectors are connected edge to edge to form a unitary connector member.

13. A container as recited in claim 1, wherein said plurality of connectors are each made from polyvinyl chloride.

14. A container as recited in claim 1, wherein each of said plurality of connectors comprises:

first and second mating parts, said first mating part having a first end formed for insertion into one of said plurality of hollow tubes, and a second end forming a first mating structure, and said second mating part having a first end formed for insertion into one of said hollow tubes and a second end having a second mating structure which is complementary in shape to said first mating structure.

15. A container as recited in claim 14, wherein said first mating structure has a male +-shape, and said second mating structure has a complementary female +-shape.

16. A container as recited in claim 14, wherein said first mating structure has a male frusto-conical shape, and wherein said second mating structure has a complementary female frusto-conical shape.

17. A container as recited in claim 1, further comprising a bottom piece closing one end of said container.

18. A substantially cylindrical, thermally insulating container for a beverage receptacle, comprising:

a plurality of flexible tubes joined edge to edge and forming a substantially cylindrical wall of said container, each of said plurality of tubes having first and second ends;

a connector including a plurality of individual connecting elements connected edge to edge, each connecting element having a first end inserted in and bonded to a first end of a respective one of said plurality of tubes, and a second end inserted in and bonded to a second end of said respective one of said plurality of tubes; and a substantially circular bottom portion closing one end of said cylindrical container, whereby said first and second ends of said flexible tubes and said bottom portion are connected to form a substantially cylindrical inner surface of said container to accommodate a substantially cylindrical outer surface of a beverage receptacle.

* * * * *